US005394719A

United States Patent [19]

Fang

[11] Patent Number: 5,394,719

[45] Date of Patent: Mar. 7, 1995

[54] ORNAMENT FOR BUTTONS

[76] Inventor: Hsien-Chung Fang, P.O. Box 82-144, Taipei, Taiwan, Prov. of China

[21] Appl. No.: 120,775

[22] Filed: Sep. 15, 1993

Related U.S. Application Data

[63] Continuation of Ser. No. 27,818, Mar. 8, 1993, abandoned.

[51] Int. Cl.[6] ..... A44C 25/00

[52] U.S. Cl. ..... 63/2; 24/113 MP

[58] Field of Search ..... 63/1.1, 2, 12, 14.1, 63/21; 24/90.5, 90 A, 113 R, 113 MP

[56] References Cited

U.S. PATENT DOCUMENTS

| | | | |
|---|---|---|---|
| 2,776,434 | 1/1957 | Ellestad | 24/113 MP |
| 2,906,045 | 9/1959 | Stein | 24/113 MP |
| 3,316,601 | 5/1967 | Ryan | 24/113 MP |
| 3,584,349 | 6/1971 | Shubart | 24/113 MP |
| 3,777,336 | 12/1973 | Anderson | 24/113 MP |
| 3,934,313 | 1/1976 | Hocq | 24/113 MP |
| 4,539,731 | 9/1985 | Torrini | 24/113 MP |
| 5,033,168 | 7/1991 | Sbragi | 24/113 MP |

*Primary Examiner*—Michael J. Milano
*Attorney, Agent, or Firm*—Alfred Lei

[57] ABSTRACT

This invention relates to an improvement in an ornament for buttons and in particular to one which includes a circular member formed with a U-shaped bracket having an upper edge and two lugs, a base plate provided two pin portions hingedly connected with the lugs of the circular member and a central resilient member between the two pin portions at an end, an intermediate portion concaving downwards, and two prongs extending upwardly from the intermediate portion and defining an elongated slot therebetween, and an ornamental member fixedly attached on said base plate, whereby the ornamental member can be conveniently and firmly engaged with the button.

1 Claim, 4 Drawing Sheets

ORNAMENT FOR BUTTONS

CROSS-REFERENCE

This application is a continuation of the patent application Ser. No. 08/027,818, filed on Mar. 8, 1993, abandoned.

BACKGROUND OF THE INVENTION

It has been found that the conventional ornament for buttons sold in the marketplace consists of a cap 100 and a base plate 200 connected with the cap via a hinge 220 in which the base plate 200 is provided with a pair of prongs 210 for keeping a button in place, a center hole 230, and a slot 240 (see FIGS. 1A, 1B and 1C). When in use, the base plate 200 is first slid beneath a button (not shown) and then covered with the cap 100 so that the button is enclosed within the ornament. However, the button is fixedly engaged with the ornament and so it can freely rotate with respect to the ornament thereby making it impossible to be oriented at a fixed direction. Hence, as to Ornaments with a design to be oriented at a certain direction, their utilization and beauty will be completely ruined and destroyed due to the fact that they cannot be correctly oriented at a predetermined direction.

In U.S. Pat. No. 2,880,487 to T. R. Ryan, an interchangeable ornament for buttons is enclosed. Nevertheless, such an interchangeable ornament for buttons is not fixedly connected with the button and can freely rotate with the respect to the button thereby making it impossible to be oriented at a predetermined direction.

U.S. Pat. No. 3,316,601 to T. R. Ryan teaches an interchangeable ornament for button. However, as the previous U.S. Pat. No. 2,880,487, the ornament for buttons according to this reference is still rotatable with respect to the button and cannot be correctly oriented.

Therefore, it is an object of the present invention to provide an improvement in an ornament for buttons which can obviate and mitigate the above-mentioned drawbacks.

SUMMARY OF THE INVENTION

This invention relates to an improvement in an ornament for buttons.

It is the primary object of the present invention to provide an ornament for buttons which can be kept at a predetermined oriented position.

It is another object of the present invention to provide an ornament for button's which can completely enclose a button.

It is still another object of the present invention to provide an ornament for buttons which is simple in construction.

It is still another object of the present invention to provide an ornament for buttons which is easy to use.

It is a further object of the present invention to provide an ornament for buttons which is facile to manufacture.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1A:
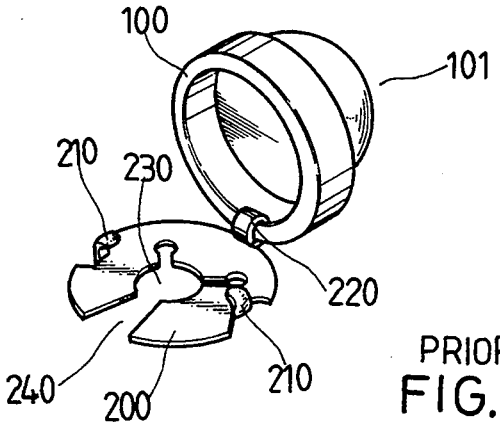
PRIOR ART FIG. 1A
FIG. 1A is a perspective view of a prior art ornament for buttons.
Figure 1B:
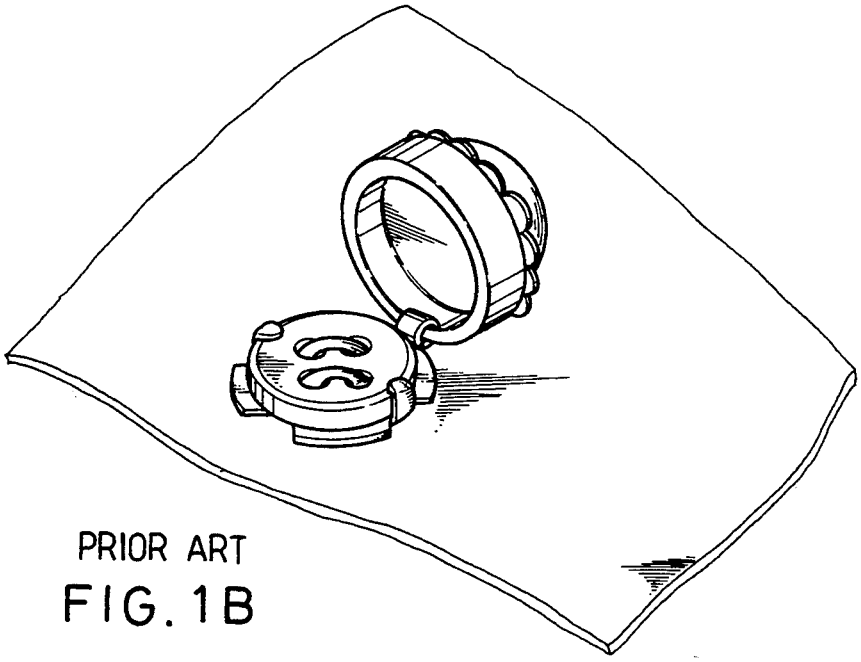
PRIOR ART FIG. 1B
FIG. 1B shows the way to engage the prior art ornament with a button.
Figure 1C:
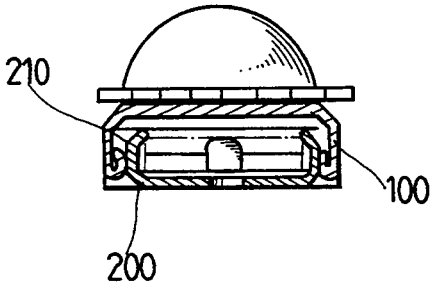
PRIOR ART FIG. 1C
FIG. 1C is a sectional view of the prior art ornament for buttons.
Figure 2:
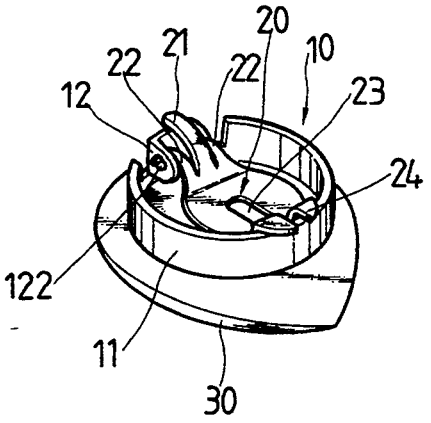
FIG. 2 is a perspective view showing the upper part of the present invention.
Figure 3:
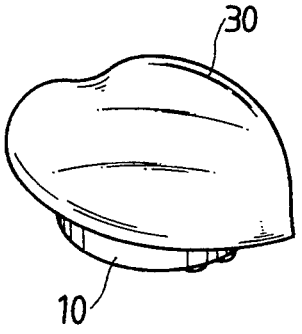
FIG. 3 is a perspective view showing the lower part of the present invention.
Figure 4:
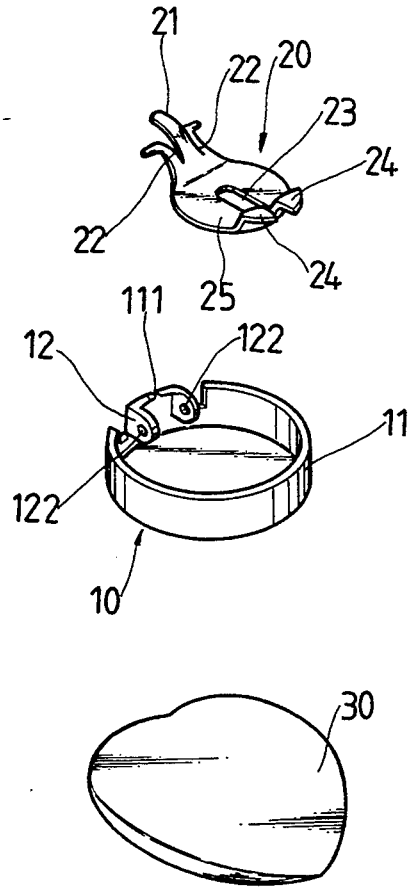
FIG. 4 is an exploded view of the present invention.

With reference to the drawings and in particular to FIGS. 2, 3 and 4 thereof, the ornament for buttons according to the present invention mainly comprises a circular member 10, a base plate 20, and an ornamental member 30.

The circular member 10 is integrally formed with a U-shaped bracket 11. The U-shaped bracket 11 is provided with an upper edge 111 and two lugs 12 each having a hole 122.

The base plate 20 is provided at one end with two pin portions 22 adapted engage with the two lugs 12 of the U-shaped bracket 11 so that the base plate 20 may be rotated with respect to the U-shaped bracket 11. Between the two pin portions 22 of the base plate 20 there is a central resilient member 21 which rests on the upper edge 111 of the U-shaped bracket 11. In addition, the base plate 20 concaves downwards (with respect to FIG. 4) at the intermediate portion 25. Further, the base plate 20 is provided at the other end with two prongs 24 extending upwardly from the intermediate portion 25 and defining an elongated slot 23 therebetween.

The ornamental member 30 is connected with the base plate 20 simply by adhesive or the like. The connection between the ornamental member 30 and the base plate 20 may be of any conventional design well known to those skilled in the art and is not considered a part of the invention.

Figure 5:
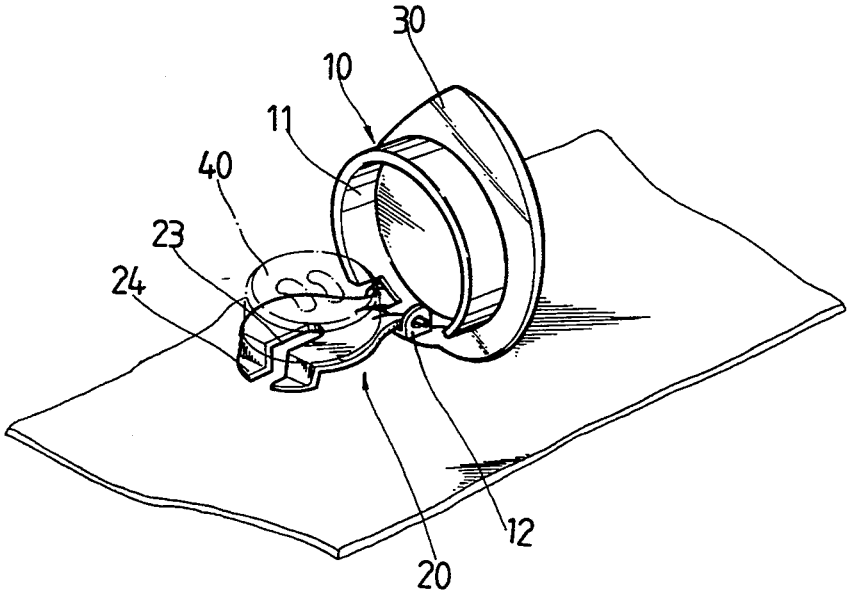
FIG. 5 shows the way to engage the present invention with a button.
Figure 6:
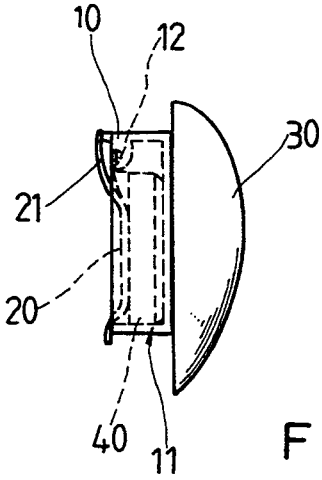
FIG. 6 shows the working principle of the present invention.

Looking now at FIGS. 5 and 6, the way to engage the present invention with a button is illustrated. When in use, first open the ornamental member 30 and slide the prongs 24 of the base plate 20 beneath the button 40. If the ornamental member 30 is not correctly oriented, simply rotate the ornamental member 30 together with the base plate 20 so as to adjust the ornamental member 30 to the correctly oriented position. Then, close the ornamental member 30 so that the button 40 is fitted between the ornamental member 30 and the base plate 10 and pressed against the ornamental member 30 by the base plate 10 thereby enabling the ornamental member 30 to be kept at a predetermined oriented position.

The invention is naturally not limited in any sense to the particular features specified in the forgoing or to the details of the particular embodiment which has been chosen in order to illustrate the invention. Consideration can be given to-all kinds of variants of the particular embodiment which has been described by way of example and of its constituent elements without thereby departing from the scope of the invention. This invention accordingly includes all the means constituting technical equivalents of the means described as well as their combinations.

I claim:

1. An ornament for a button comprising:

a circular member formed with a U-shaped bracket having an upper edge and two lugs;

a base plate provided at one end with two pin portions hingedly connected with the lugs of said circular member and a central resilient member between said two pin portions, said base plate concaving downwards at an intermediate portion and being provided at the other end with two prongs extending upwardly from the intermediate portion and defining an elongated slot therebetween; and an ornamental member fixedly attached on said base plate.

* * * * *